United States Patent [19]

Jager

[11] Patent Number: 4,986,091

[45] Date of Patent: Jan. 22, 1991

[54] PROCESS AND WARP KNITTING MACHINE FOR THE PRODUCTION OF PILE WARE

[75] Inventor: Horst Jager, Heusenstamm, Fed. Rep. of Germany

[73] Assignee: Karl Mayer Textilmaschinenfabrik, Fed. Rep. of Germany

[21] Appl. No.: 390,968

[22] Filed: Aug. 7, 1989

[30] Foreign Application Priority Data

Nov. 8, 1988 [DE] Fed. Rep. of Germany ..... 3827265

[51] Int. Cl.[5] ..... D04B 23/22

[52] U.S. Cl. ..... 66/84 R; 66/192; 66/204

[58] Field of Search ..... 66/84 R, 84 A, 204, 66/91, 192

[56] References Cited

U.S. PATENT DOCUMENTS

| | | | |
|---|---|---|---|
| 471,350 | 3/1892 | Cooper | 66/84 R |
| 2,040,326 | 5/1936 | Nebel | 66/91 |
| 2,192,556 | 3/1940 | Nebel | 66/91 |
| 2,452,579 | 11/1948 | Lambach | 66/84 |
| 2,694,301 | 11/1954 | Boyer | 66/204 |
| 2,957,327 | 10/1960 | Glover | 66/192 |
| 3,710,598 | 1/1973 | Wilkens | 66/192 |
| 3,857,260 | 12/1974 | Zwingenberger et al. | 66/84 R |
| 4,055,969 | 11/1977 | Wilkens | 66/204 |
| 4,266,411 | 5/1981 | Lindner et al. | 66/84 R |
| 4,823,563 | 4/1989 | Wunner | 66/84 R |

*Primary Examiner*—Werner H. Schroeder
*Assistant Examiner*—John J. Calvert
*Attorney, Agent, or Firm*—Omri M. Behr

[57] ABSTRACT

There is disclosed a process for the manufacture of pile ware on warp knitting machine. The machine has a single needle bar and pile sinkers. The base threads and the pile threads are contemporaneously laid about the needles. During the swing associated with the underlap into the overlap position, first the base threads and then the pile threads are laid onto the needle backs and slid off from said needle backs with separation from each other. The pile sinkers are led into the space between the base and pile threads during the swing-through and remain there until the knock-over of the stitch. There is further provided an apparatus for carrying out the above process by means of a warp knitting machine for the production of pile ware. The machine has a needle bar, laterally displaceable bars for base and pile threads and a laterally non-displaceable pile sinker bar carrying a pile sinker interacting with each needle gap. The pile sinker bar and the needle bar are so provided that in the rest position, the free ends of the pile sinkers do not protrude beyond the needle backs. In the pile forming position, the free ends of the pile sinkers protrude beyond the needle backs and are moveable to and fro. In operation the pile thread bar swings from the underlap position into the overlap position as the last guide bar. The machine also has a control arrangement that activates the forward movement when the guide bars are in or close to the overlap position. The pile sinkers are so oriented that their free ends pass between the pile threads and the base threads during the forward movement.

15 Claims, 5 Drawing Sheets

PROCESS AND WARP KNITTING MACHINE FOR THE PRODUCTION OF PILE WARE

The invention is directed to a process for the production of pile ware by means of a single-bedded warp knitting machine provided with pile sinkers in which the base and pile threads are contemporaneously lapped about the needles, as well as to a warp knitting machine for the production of pile ware equipped with a needle bar, laterally displaceable guide bars for base and pile threads, as well as a laterally indisplaceable pile sinker bar provided with pile sinkers passable through the needle gaps.

A process and a warp knitting machine of this type is disclosed in Mailland Textile Berichte 12/1971, page 1407 through 1413, in particular, illustration No. 3. In such a machine the pile sinkers are immovably provided in the needle gaps. The pile threads are laid as tricot stitches and alternately form stitches to the left and to the right next to the appropriate sinkers. As base threads, chain stitches are used, so that before the production of a stable base fabric it is necessary to provide weft thread inlays, as well as the corresponding magazine inlay arrangement. The guide bar is so provided that during the swing from the underlap into the overlap position, first the pile threads and then the base threads for building the chain stitch, are led through the needle gap. In such an arrangement only a single type of base fabric may be produced which, in view of the need for the magazine weft inlay arrangement, is rather expensive.

It is further known (DE-PS 2435312) that pile ware may be produced where the base threads are laid as tricot stitches and the pile threads are laid as chain stitches. This requires that the pile sinker bar is displaceable laterally by one needle space. Even in this arrangement, the lapping of the pile threads is closely coupled to the lapping of the base threads. In case it is necessary to strengthen the base fabric a second base thread system would be necessary, thus again, a weft thread insertion arrangement is foreseen It is further known (DE-OS 2832481) to produce pile ware on a twin bedded warp knitting machine. In such a machine, it is simple to combine together different types of binding for the base and pile threads and furthermore, it is possible to provide additional base thread systems over further guide bars. However, because of the double bedded nature of the equipment, it is necessary to additionally provide for a cutting machine and thus, higher investment costs are required.

SUMMARY OF THE INVENTION

In accordance with the illustrative embodiments demonstrating features and advantages of the present invention, there is provided a process for the manufacture of pile ware with pile threads and base threads on a warp knitting machine. This machine has pile sinkers and a single needle bar with needles having needle backs. The process contemporaneously lays the base threads and the pile threads about the needles. The process includes the step of swinging the base and pile threads from an underlap into an overlap position, laying first the base threads and then the pile threads onto the needle backs. Another step is sliding upon the needle backs the base and pile threads with a separation between them. Another step is moving the pile sinkers into the thread space formed between the base and pile threads during the swinging step. The pile sinkers remain in this space until stitch knockover occurs.

In a related warp knitting machine for the production of pile ware from base and pile threads, according to the principles of the same invention, there is provided a needle bar having a plurality of needles, each having a needle back. The machine also has a reciprocateable base thread bar for the base threads and a reciprocateable pile thread bar for the pile threads. The pile thread bar is operable to swing from an underlap position into the overlap position as the last guide bar. Also included is a laterally indisplaceable pile sinker bar having a plurality of pile sinkers for interacting with each interneedle gap. This pile sinker bar and the needle bar are mounted to relatively reciprocate. The pile sinkers have a rest position wherein their free ends do not protrude beyond the needle backs. The pile sinkers have a pile forming position wherein their free ends protrude beyond the needle backs. The machine also has a control means for moving the pile sinker bar and inserting the free ends of the pile sinkers between the pile threads and the base threads when the pile and base thread bars are in or close to the overlap position.

The purpose of the invention is to produce pile ware on a single bedded warp knitting machine in which it is possible to provide a greater number of binding combinations of the base and pile threads than heretofore.

This problem is solved in the previously described procedure by arranging that the through-swing associated with the movement from the underlap to the overlap position the base threads, and then the pile threads are laid onto the needle backs and permitted to slip off therefrom with separation therebetween, and the pile sinkers during or after the through swing are led into the separation between the base and pile threads and left there until the knock-over of the stitch.

Since the base and warp threads separate when they slide along the needle back, even though there are unavoidable thread crossings, there is sufficient room between the base and pile threads for the pile sinkers to be readily introduced therebetween. It is thus possible to separate the base and pile threads from each other in such a way that the one can form the base fabric and the other can form the pile loops. The best results are shown at the end of the through-swing since then the base threads have moved substantially in the direction of the foot of the needle and a relatively large gap has been formed and in particular in the overlap situation, since there the base and pile threads form substantially space-fixed gaps, into which the pile sinkers can very easily be introduced.

By means of this process, textile designers may create a very large number of different types of pile ware in which there are different parings of base and pile thread bindings. It is thus possible to provide a combination of base fabric and pile for practically every need which heretofore was not possible.

In particular, there exists the possibility of working at least two base thread systems with different displacement movements. It is therefore possible to produce a stable base fabric of substantial levels of tear resistance without the need for the introduction of weft thread inserts. Furthermore, where a base fabric has a single base thread system (e.g., a tricot which has a sideward bias which upon occasion may be considered to be optically objectionable), objections can be avoided by working a second base thread system in the opposite direction.

The differentiable displacement movement of the two base thread systems can be provided, wherein the displacement takes place over different needle spacings. A preferred solution rests wherein both base thread systems are worked in opposite lapping directions. This leads to an exceedingly regular and stable base fabric.

Another possibility of differentiable displacement movement resides wherein one thread system is provided as a chain stitch and the other as a partial weft insert. Both of these approaches lead to a corresponding base fabric without the need for weft insertion threads.

A warp knitting machine of the prior art may be utilized for the solution of the problem posed herein when modified in the following manner: The pile sinker bar and the needle bar are oriented to each other in such a way that in the rest position, the free ends of the pile sinkers do not protrude beyond the needle backs. In the pile formation position, the free ends of the pile sinkers are arranged to protrude beyond the needle backs and to be moveable to and fro. The pile thread guide bar is arranged to swing from the underlap position into the overlap position as the last guide bar. A control arrangement is provided to activate the forward movement when the guide bars are in or proximate to the overlap position and the pile sinkers are so provided that in the forward movement the free ends of the pile sinkers protrude between the pile threads and the base threads.

The arrangement of the guide bars results in the base threads sliding along the needle back in front of the pile threads. The arrangement of the pile sinkers and the relative movement between the pile sinker bar and the needle bar results in the desired separation of the pile threads and the base threads. The structure of a conventional warp knitting machine can be readily modified to accomplish these results. The relevant to and fro movement requires an exceedingly small path.

Suitably, at least two base thread bars are utilized which are provided for different displacement movements. This permits the base fabric to be produced from one or more base thread systems.

In particular, the base thread bars are displaceable to lap in opposite directions. At the same time or alternatively, the base thread bars can be provided to be displaceable over a different number of needle gaps. There is also the possibility that one base thread bar can be arranged for the provision of chain stitches and the other base thread bar for the provision of partial weft inserts.

In a further embodiment, there may be provided at least two pile thread bars which swing from the underlap position to the overlap position as the last guide bars. This means that also in the case of the pile laps, additional combinations are possible.

It is desirable to provide a tapering of the free ends of the pile sinkers This means that comparatively small spaces between the threads are accommodated when the pile sinkers perform their separation function. As soon as the free end intervenes into the separation space, the pile and base threads are pushed apart by the pile sinkers.

The free end should be located as close as possible to the pile thread side of the pile sinker. That is to say, the base threads are pushed towards the needle foot, while the pile threads are held substantially in position. It is advantageous if the free end of the pile sinkers on the pile thread side are provided with a small rise. This rise prevents the slippage of the pile threads during the formation of the stitch.

In the simplest case, the pile sinker bar is displaceable for the provision of a back and forth movement. The needle bar can thus retain its spatial location. There is however, also, the possibility that the pile sinker bar is immovable and the needle bar is displaceable to provide the back and forth movement, or it is further possible to provide that both the pile sinker bar and the needle bar are moveable.

It is further advantageous that the pile sinker bar is arranged to provide a component of the movement of the sinkers in the direction of motion of the needles. This enables a better separation of the pile and base threads to occur.

It is particularly advantageous that the rest position is so chosen that the free ends of the pile sinkers are still located between the movement paths of adjacent needles. This has the consequence that in each cycle, the hooks of the needles move between the pile sinkers but the pile sinkers need not protrude between the needle shafts. Since the hooks have a lesser breadth than the shafts, there is no danger collision between them.

A further embodiment is found wherein the projection of the guide bars on the plane of the needle bed is displaced forwardly to the knock-over edge during the swing from the underlap into the overlap position. Through this displacement, the base threads slide particularly low on the needle backs so that a very desirable separation between the pile and the base threads is achieved.

BRIEF DESCRIPTION OF THE DRAWINGS

The invention is illustrated, as to its preferred embodiments, in the following drawings which show.

DETAILED DESCRIPTION OF THE PREFERRED EMBODIMENTS

Figure 1:
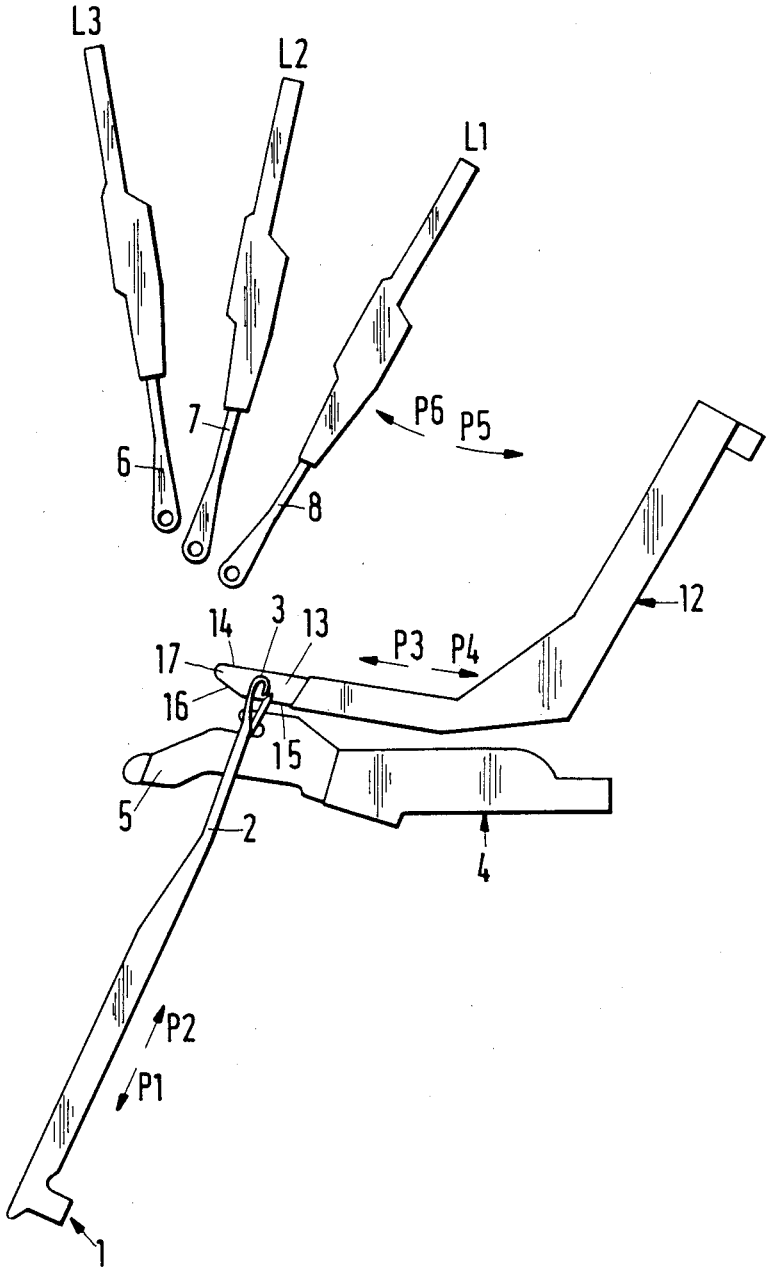
FIG. 1—The working area of a warp knitting machine of the present invention in knock-over position.

In the drawings the only parts of the warp knitting machine which are illustrated are those necessary for the understanding of the invention.

Figure 2:
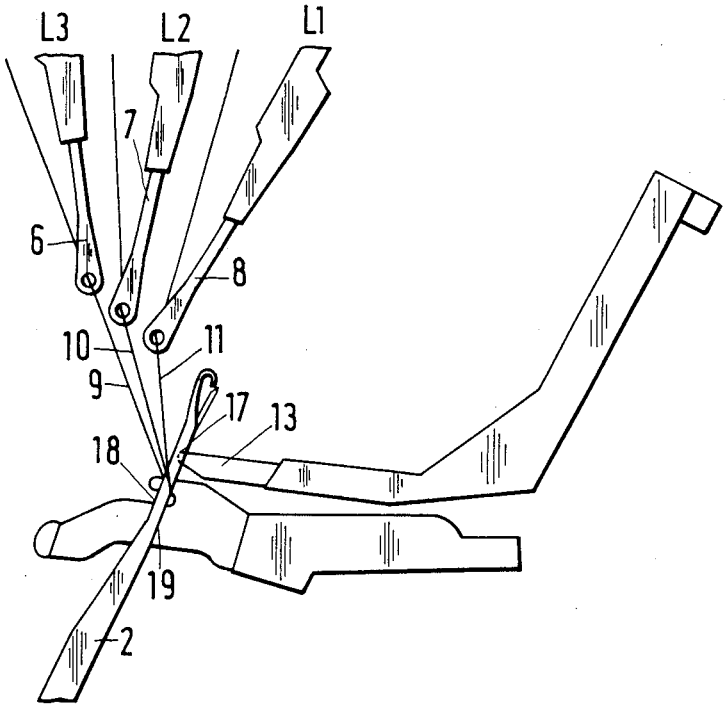
FIG. 2—The area of FIG. 1 in underlap position.
Figure 3:
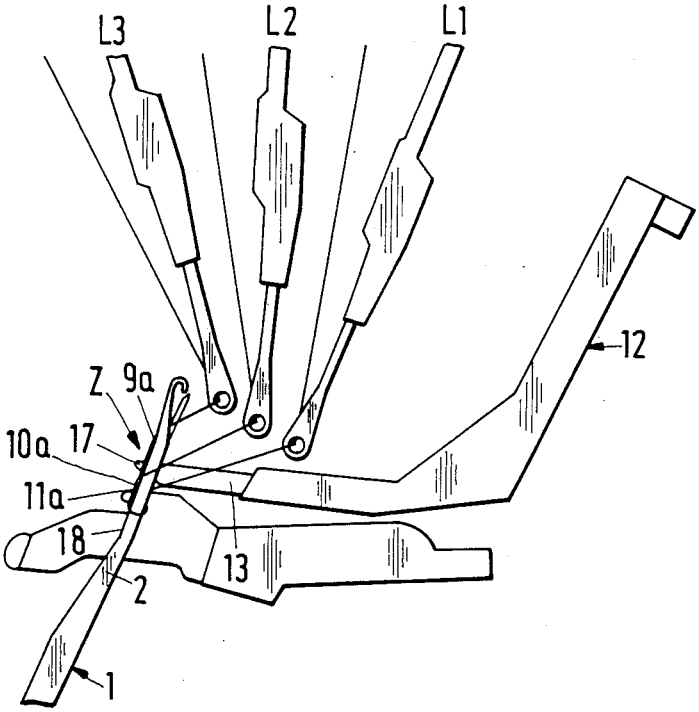
FIG. 3—The area of FIG. 1 in overlap position.

Referring to FIGS. 1, 2 and 3, needle bar 1 comprises a plurality of needles 2 equipped with the corresponding hooks 3. The needles may, in normal fashion, be Raschel needles, tongue needles and, preferably, slider needles. A further bar 4 carries the closing knock-over sinkers 5. There are provided three guide bars L1, L2, L3 with corresponding guides 8, 7 and 6. The guides 6 carry the pile threads 9; the guides 7, the first base threads 10 and the guides 8, the second base threads 11, as will be seen in FIGS. 2 and 3.

Figure 4:
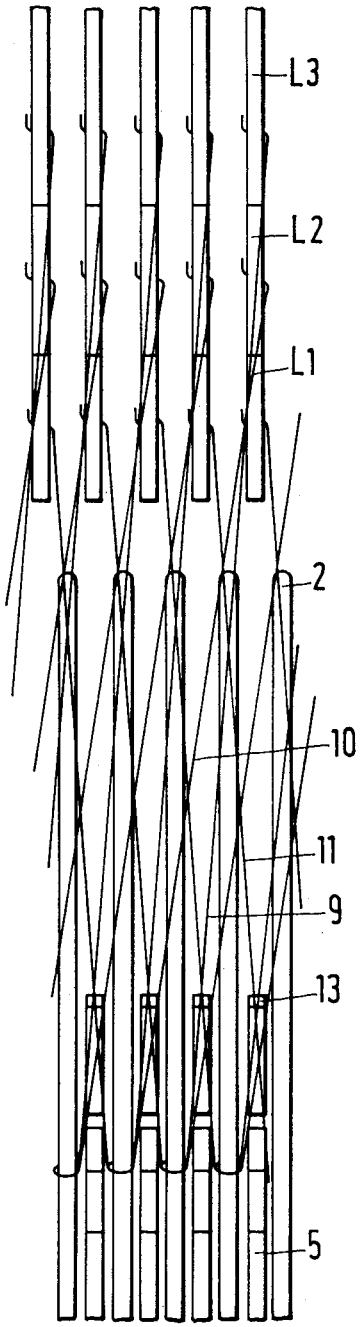
FIG. 4—A partial side view from the right onto FIG. 2.

Furthermore, there is provided a pile sinker bar 12 carrying pile sinkers 13. These are provided with upper surfaces, designated pile thread side 14, and a lower surface 15 which, in the front, have angled surfaces 16. In this way, the free end 17 of the pile sinker 13 is located proximate to the pile thread side 14. These pile sinkers are illustrated in FIG. 2 in the rest position, in which the free end 17 is located between the back-face 18 and the front-face 19 of the needles. The pile sinkers are sidewardly non-displaceable, that is to say, non-displaceable in the direction along the length of pile sinker bar 12, but they are moveable in the plane of the pile sinkers from the rest position, shown in FIG. 2, into a pile forming position, in which the free end 17 protrudes beyond the needle backs 18. FIG. 3 illustrates the pile sinkers during this forward movement, while FIG. 1 shows them at the end of this movement. In this action, the pile sinkers pass through the gap Z between pile threads 9 and the base threads 10 and 11, which is further more clearly illustrated in FIGS. 4 and 5.

Figure 5:
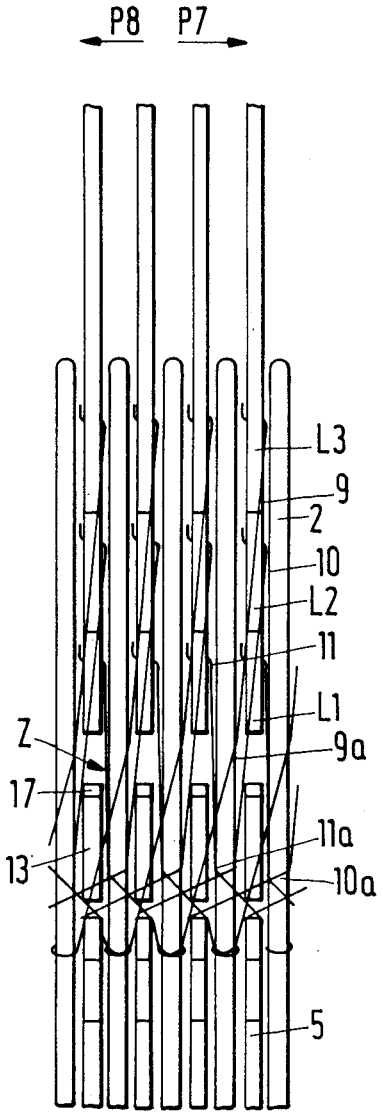
FIG. 5—A partial side view from the left onto FIG. 3.

The individual portions substantially carry out the following movements which are caused by the control arrangements P1 to P8, illustrated by the "arrows". The needles in each cycle move upwards (P1) and downwards (P2) (FIG. 1). The pile sinkers 13 move to and fro (P3 and P4) (FIG. 1). The guide bars L1, L2 and L3, can move from the underlap position swinging through into the overlap position (P5) and correspondingly in the reverse direction (P6) (FIG. 1). Further, the guide bars can each be displaced to and fro (P7 and P8), in their longitudinal direction (FIG. 5). The control of such movements is carried out in the usual manner, that is to say, cams, pattern chains and the like.

When the guide bars L1, L2 and L3 have completed an underlap displacement and then have swung through from the underlap position shown in FIG. 2 into the overlap position shown in FIG. 3, the base thread 11, then the base thread 10, and finally the pile thread 9, are laid on the needle back 18. During the through-swing (P5) the threads slide downwardly on needle backs 18, wherein there is a space formed at least between the pile threads 9 and the base threads 10. As shown in FIG. 5, turn around points 9*a*, 10*a* and 11*a* are formed which, at the end of the through-swing, have a clearly defined position and even before each through-swing position, are precisely positioned. Because of the aforementioned separation, a space Z is formed into which the forward ends 17 of the pile sinker 13 may be introduced during the forward swing (P3). Because of the tapering of the free end 17, space Z may be comparatively small and yet a safe separation between the pile and base threads will be achieved.

The base threads are then led downwardly by the angled surface 16, whereas the pile threads remain on the upper side. When finally the stitch is formed and is knocked over, the pile threads still remain on the pile thread side 14 of pile sinker 13, so that a pile loop is obtained. After the formation of the stitch, the pile sinker bar 12 is again moved back to its rest position, as shown in FIG. 2 (P4).

As a comparison of FIG. 2 and FIG. 3 shows, the projection of the guide bars L1, L2 and L3 onto the plane produced by the bed of needles 2 is displaced during the swing-through (P5) from the underlap to the overlap position downwardly toward the knock-over edge of the closing knock-over sinker 5. Thus, the downward slide of the threads on the needle back 18 is further facilitated. This is achieved by providing that the swing axis of the guide bars is separated from the aforementioned plane on the hook side.

Figure 6:
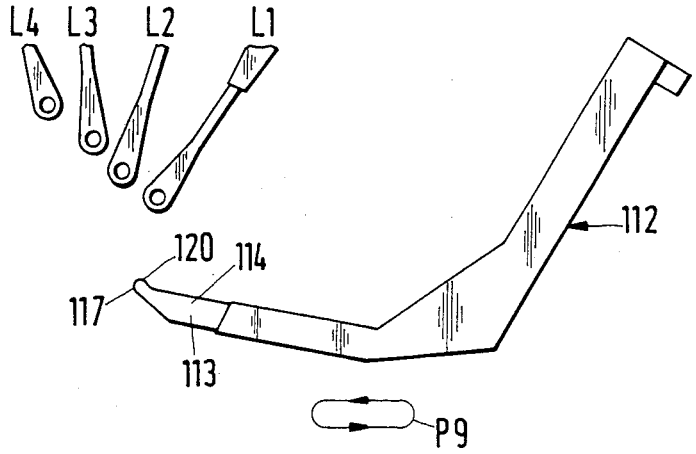
FIG. 6—An preferred embodiment of a pile sinker which is an alternate to that of FIG. 1.

It may further be seen from FIG. 6 that two pile thread bars L3 and L4 are provided to allow working in a two-pile thread system. The guide bar L4 may work a different displacement pattern from guide bar L3.

In the embodiment shown in FIG. 6, there is illustrated a pile sinker bar 112 with pile sinkers 113, whose free ends 117 have rises 120 on the pile side 114. This rise or nose prevents the unintended slip-off of the pile threads during pile formation. This guide arrangement provides for the movement path (P9), wherein the previously illustrated motion (P3 and P4), may be further provided a movement component in the direction of the travel path of the needles. This serves further to press the base threads in a downward direction.

Figure 9:
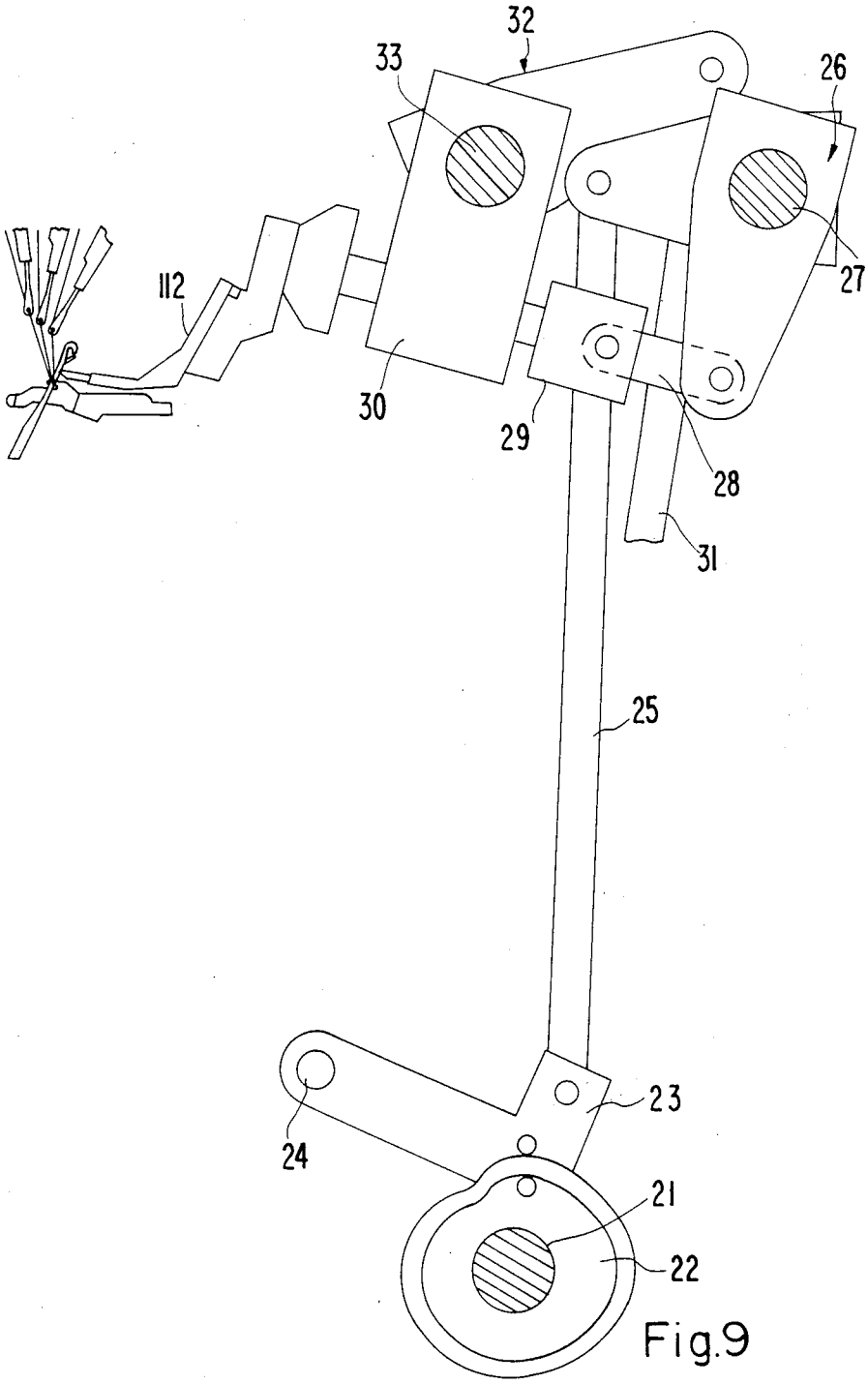
FIG. 9—A drive mechanism for moving the pile sinker bar of FIG. 6.

The combined vertical and horizontal movement of pile sinker bar 112 illustrated in FIG. 6 can be achieved with the structure of FIG. 9. Fixedly mounted on main shaft 21 is cam disk 22. Disk 22 reciprocates lever 23, which is pivoted about an axis 24, to operate push rod 25 to cause the horizontal motion. Rod 25 connects to one arm of double armed lever 26 to reciprocate it about axis 27. The other arm of lever 26 is connected by intermediate transfer element 28 to a slider 29 which carries the pile sinker bar 112. Slider 29 is slideable in bearing block 30 in a forward and backwards manner. This corresponds to the back and forth movement P3 and P5 of the pile sinker bar.

A further, unillustrated, cam disk is similarly mounted on main shaft 21 to reciprocate push rod 31 which drives a first arm of another double armed lever 32 to cause the vertical motion. This lever 32 is rotatably mounted around axis 33 and has a second arm formed into bearing block 30. This carries out the vertical movement of the pile sinker bar 112 which is incorporated in the P9 reciprocal movement.

Figure 7:
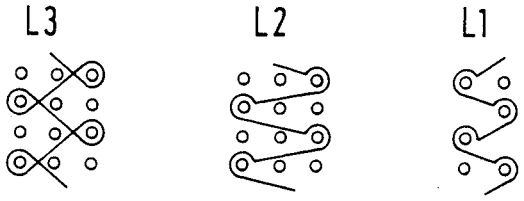
FIG. 7—A lapping diagram for a first example.

FIG. 7 shows, in the usual format, how the base threads and the pile threads are laid by means of the guide bars. Thus, the base threads 11 are laid by guide bar L1 as opposing tricot stitches with open loop formation and the base threads 10 by guide bar L2, as Jersey stitch (1,0-2,3 lap) with open loop formation and the pile threads 9 with guide bar L5 as Jersey stitch with closed loop formation.

Figure 8:
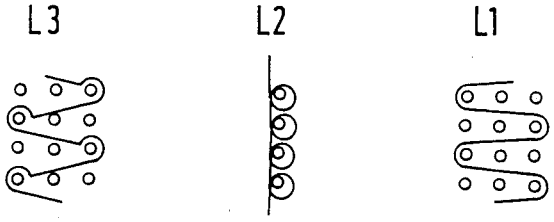
FIG. 8—A lapping diagram for a second example.

FIG. 8 shows the base threads 11 laid by guide bar L1 as a partial weft insert pattern; the base threads 10 with guide bar L2 as chain stitches with closed loop formation; and the pile threads 9 with guide bar L5 as Jersey stitch (1,0-2,3 lap) with off/open loop formation.

Furthermore, there exists a large number of other combinations of known binding and lapping types which may be produced in accordance with the above-disclosed principles. One merely has to be certain that the desired separation is maintained until the completion of the pile loop.

Even though the drawings illustrate a warp knitting automat, the principles of the present invention may also be employed on a Raschel machine.

I claim:

1. A process for the manufacture of pile ware with pile threads and base threads on a warp knitting machine having pile sinkers and a single needle bar with needles having needle backs, the process contemporaneously laying the base threads and the pile threads about the needles and comprising the steps of:

swinging the base and pile threads from an underlap into an overlap position, laying first the base threads and then the pile threads onto the needle backs;

sliding upon said needle backs said base and pile threads with a separation between them; and moving the pile sinkers into the thread space formed between said base and pile threads during the swinging step in a reciprocating manner with a component of motion in a direction parallel to the upward motion of the needles, said pile sinkers remaining in said space until stitch knock-over occurs.

2. A process in accordance with claim 1 employing at least two base threads, the step of contemporaneously laying being performed by laying said two base threads in two different patterns

3. A process in accordance with claim 2 wherein said two base threads are worked in opposite lapping directions.

4. A process in accordance with claim 2 wherein one of the two base threads is provided as chain stitches and the other is provided in a partial weft insert pattern.

5. Warp knitting machine for the production of pile ware from base and pile threads, comprising:

a needle bar having a plurality of needles, each having a needle back;

a reciprocateable base thread guide means having at least one base thread bar for guiding the base threads;

a reciprocateable pile thread guide means having at least one pile thread bar for guiding the pile threads, the pile thread guide means being operable to swing from an underlap position into the overlap position trailing said base thread bar;

a laterally indisplaceable reciprocateable pile sinker bar having a plurality of pile sinkers for interacting with each interneedle gap, said pile sinker bar and said needle bar being mounted to relatively reciprocate in a reciprocating manner with a component of motion in a direction parallel to the upward motion of the needles, said pile sinkers having a rest position wherein their free ends do not protrude beyond the needle backs, said pile sinkers having a pile forming position wherein their free ends protrude beyond the needle backs;

a control means for moving said pile sinker bar and inserting the free ends of the pile sinkers between the pile threads and the base threads when the pile and base thread guide means are in or close to the overlap position.

6. Warp knitting machine in accordance with claim 5 wherein said base thread guide means comprises at least two independent pluralities of base thread guides mounted to move in different patterns.

7. Warp knitting machine in accordance with claim 6 wherein the two pluralities of base thread guides are operable to be displaced in opposite lapping directions.

8. Warp knitting in accordance with claim 7 wherein the two pluralities of base thread guides are displaceable by a different number of needle spaces.

9. Warp knitting machine in accordance with claim 8 wherein one of said pluralities of base thread guides is operable to produce chain stitches and the other one of the pluralities of base thread guides is operable to produce a partial weft insertion pattern.

10. Warp knitting machine in accordance with claim 5 wherein said pile thread guide means comprises at least two independent pluralities of pile thread guides mounted to move in different patterns and to swing into the overlap position from the underlap position trailing said base thread bar.

11. Warp knitting machine in accordance with claim 6 wherein the pile sinkers are tapered at their free ends.

12. Warp knitting machine in accordance with claim 11 wherein said pile sinkers have adjacent their free ends a pile side facing said pile thread bar.

13. Warp knitting machine in accordance with claim 12 wherein each of said pile sinkers has at its pile side of its free end an upward rise.

14. Warp knitting machine in accordance with claim 5 wherein the pile sinkers have a rest position placing their free ends between neighboring ones of said needles.

15. Warp knitting machine in accordance with claim 14 wherein the projection of the base thread and pile thread bars onto the plane of the needles, is displaced towards the knock-over direction during the swing from the underlap to the overlap position.

* * * * *